United States Patent [19]

Cheng

[11] 4,233,750

[45] Nov. 18, 1980

[54] ADJUSTABLE SURFACE TEMPERATURE DETECTOR

[76] Inventor: Sheng-Hsiung Cheng, P.O. Box 17092, West Hartford, Conn. 06117

[21] Appl. No.: 973,148

[22] Filed: Dec. 26, 1978

[51] Int. Cl.[3] ..... H01H

[52] U.S. Cl. ..... 337/374; 337/334

[58] Field of Search ..... 337/334, 335, 336, 349, 337/360, 362, 370, 371, 372, 380, 112, 113, 94, 341, 342, 343, 365, 374, 375

[56] References Cited

U.S. PATENT DOCUMENTS 3,913,048 10/1975 Mertler ..... 337/374

FOREIGN PATENT DOCUMENTS 671163 4/1952 United Kingdom ..... 337/374

*Primary Examiner*—Harold Broome

[57] ABSTRACT

An instrument which detects a rise in temperature of a surface; the instrument including a bimetal sensor disc which contacts a surface that is being serailled by the instrument, and which, when becoming overheated, causes the disc to snap into engagement with a contact strip, thus closing a warning alarm; and the instrument having adjustments to set off the alarm at a selected temperature.

3 Claims, 5 Drawing Figures

ADJUSTABLE SURFACE TEMPERATURE DETECTOR

This invention relates generally to electrically operated temperature alarms.

A principal object of the present invention is a temperature controlled electric switch that can be used for applications such as (1) a fire hazard warning device when temperatures rise above a pre-set temperature degree, (2) for monitoring an overheating of a motor, pump, compressor and machinery at a selected degree, (3) a switch device to turn on or off a heat source, a fan, pump or motor, (4) protecting electronic instruments from overheating, (5) monitoring and controlling a surface temperature of a hot plate for thermal experiments, (6) monitoring a pre-scorch point, (7) monitoring a hot water or steam leak, (8) controlling and maintaining a desired constant temperature, and the like.

Another object is to provide a temperature detector that has separate controls for higher or lower temperature settings, so to be adaptable for controlling a broad range of temperatures.

These and other objects will be readily evident upon a study of the following specification, and the accompanying drawing, wherein.

Figure 1:
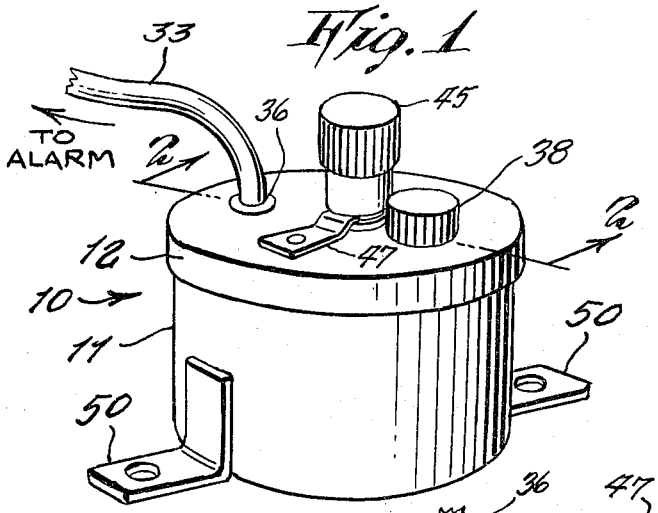
FIG. 1 is a perspective view of the instrument.

Referring now to the drawing in greater detail, the reference numeral 10 represents an adjustable surface temperature detector, according to the present invention, wherein there is a metal outer can or case 11 having a cover 12 sealed thereupon so to enclose a vertically adjustable, metal inner can or case 13. Both cases have a large, central opening 14 and 15 respectively in their bottom walls 16 and 17 respectively in order that a swtich mechanism 18 carried in the inner case may contact a surface 19 upon which the instrument is placed for temperature surveillance thereof.

The mechanism includes a round shaped, bimetallic sensor disc 20 which at its center is secured by a rivet 21 to one end of a bimetallic sensor strip 22 which at its other end is supported in an insulated manner, one end of an aluminum strip 23 which at its other end is secured by a rivet 24 in hole 25 of bottom wall 17 of the inner case. The rivet 24 extends through a Teflon gasket 26 that surrounds the opening 15 and also through a Teflon gasket pad 27. An electric conductor 28 is connected to the rivet 24.

Another electric conductor 29 is connected to a rivet 30 that electrically contacts the bimetallic sensor strip 22 and which extends through an insulation bushing 31 and insulation block 32 that electrically separate strips 22 and 23.

The conductors 28 and 29 together form a cable 33 that extends out of a hole 34 of a cover 35 sealed upon the inner case and out of a hole 36 of the outer case cover, the cable being connected to an alarm and to an electric power.

Figure 2:
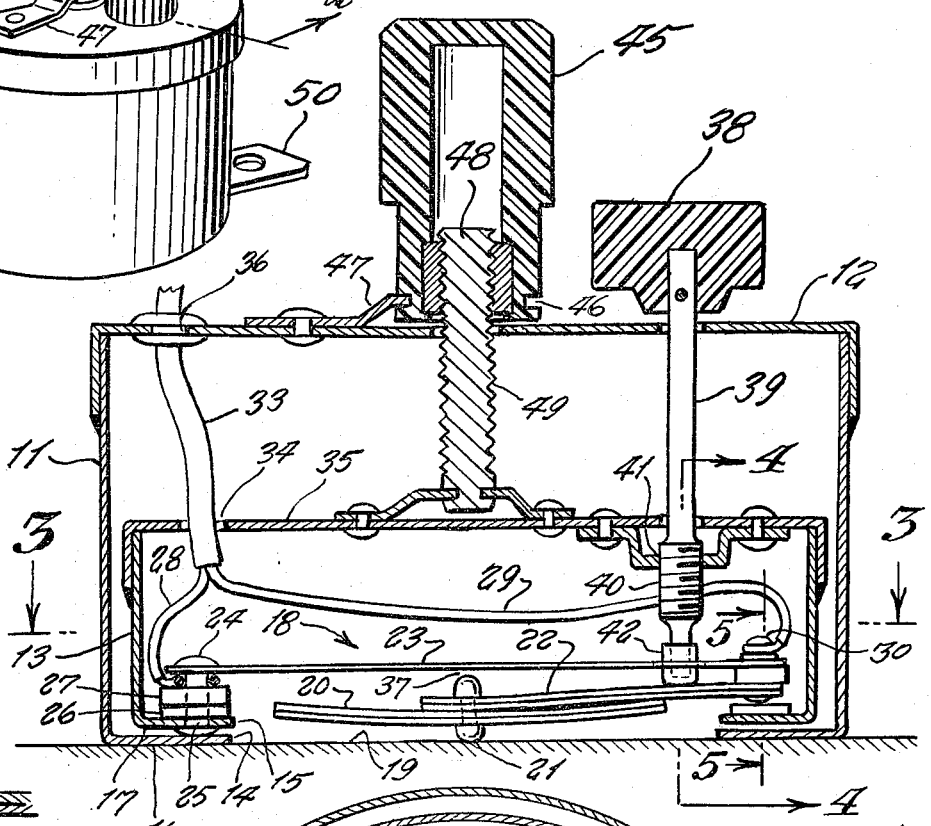
FIG. 2 is an enlarged cross-sectional view taken on line 2—2 of FIG. 1.
Figure 4:
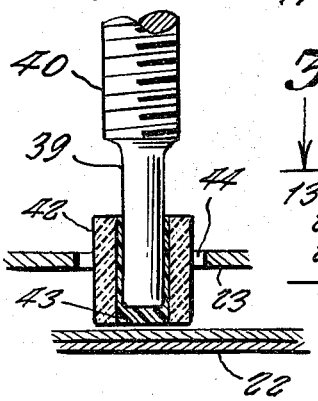
FIG. 4 is an enlarged cross-sectional view taken on line 4—4 of FIG. 2.
Figure 5:
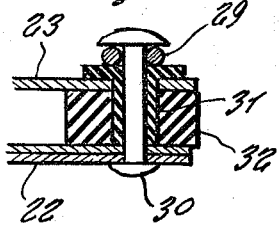
FIG. 5 is an enlarged cross-sectional view taken on line 5—5 of FIG. 2.
Figure 3:
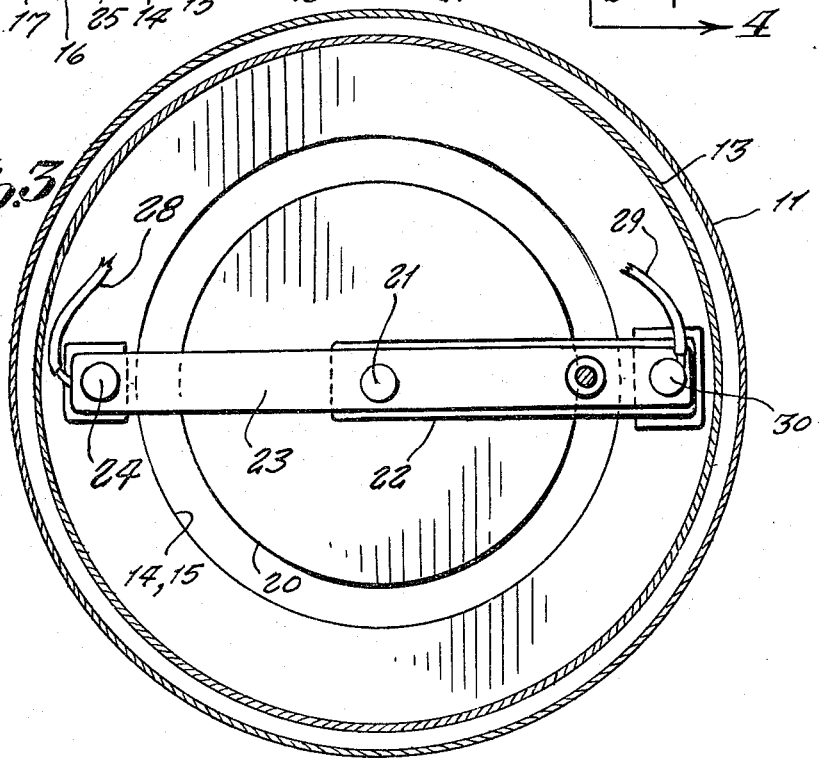
FIG. 3 is a cross-sectional view taken on line 3—3 of FIG. 2.

In a non-activated use, as shown in FIG. 2, the rivet 21 engages the surface 19, and a gap 37 exists between the rivet 21 and the underside of the strip 23.

When the surface temperature being sensed is between 80 and 200 degrees F., then the bimetallic sensor strip will bend upwardly in order to close the gap 37 by the rivet 21 contacting the strip 23. If the temperature rises over 200 degrees F., then the bimetallic sensor disc buckles upwardly into a convex dished shape and firmly presses the strip 22 upward, so that the rivet 21 moves across gap 37 and contacts strip 23, thus closing the circuit to the alarm. The disc 20 defines the maximum low temperature sensing limit and protects the bimetallic strip 22 from distortion at higher temperature range above 200 degrees F., by shielding the strip 22 from the surface 19.

The instrument includes a control knob 38 for controlling operation between temperatures of 80 to 200 degrees F. The knob is on a shaft 39 having a screw thread 40 engaged in threaded opening 41 of the cover 35 so that a lower end of the shaft bears against the strip 22 in order to force the enlargement of the gap 37, as wished. The lower end of the shaft is fitted in a ceramic sleeve 42 secured around the shaft end by epoxy 43. The sleeve extends freely through a hole 44 in strip 23.

Another knob 45 controls operation between 200 and approximately 400 degrees F. The knob 45 includes annulor groove 46 engaged by a tooth 47 secured to cover 12. An internal thread 48 in the knob engages threaded shaft 49 connected rotatably free to the inner case cover 35, so that rotation of knob 45 causes the inner case to be raised or lowered, thereby vertically adjusting the rivet 21 respective to surface 19, and controlling a size of a gap therebetween for continuous sensing of a higher temperature after exceeding lower range temperature sensing capacity.

Brackets 50 secured to the outer case are provided for mounting the instrument.

I claim:

1. An adjustable surface temperature detector, comprising in combination, an outer case, an inner case vertically adjustable in said outer case and carrying a switch mechanism, a hole in a bottom wall of each said case so that said mechanism contacts a supporting surface upon which said detector is placed; said mechanism including a bimetallic sensor disc secured by a rivet to a bimetallic sensor strip, and said mechanism includes an aluminum strip above said rivet for being contacted thereby when a temperature of said surface is raised, said strips each being connected by a conductor in an electric circuit with an alarm and a power source.

2. The combination as set forth in claim 1, wherein a first knob is on a shaft who bears against said bimetallic sensor strip for a lower range temperature sensing, said shaft having a screw thread engaged in a threaded opening through a cover of said inner case.

3. The combination as set forth in claim 2, wherein a second knob is axially affixed and rotationally free respective to a cover of said outer case, a threaded central opening through said second knob engaging a threaded shaft which at its lower end is rotationally free and axially affixed in said inner case cover.

* * * * *